United States Patent [19]

Harris

[11] 3,991,733

[45] Nov. 16, 1976

[54] SPARK IGNITION SYSTEMS FOR INTERNAL COMBUSTION ENGINES

[75] Inventor: Paul Anthony Harris, Walsall, England

[73] Assignee: The Lucas Electrical Company Limited, Birmingham, England

[22] Filed: Sept. 26, 1974

[21] Appl. No.: 509,402

[30] Foreign Application Priority Data

Sept. 28, 1973 United Kingdom ..... 45468/73

[52] U.S. Cl. ..... 123/148 E; 307/235 E

[51] Int. Cl.[2] ..... F02P 1/00

[58] Field of Search ..... 123/32 EA, 117 R, 148 E; 307/235 E, 235 J; 328/163; 324/173, 174

[56] References Cited

UNITED STATES PATENTS

| | | | |
|---|---|---|---|
| 3,357,416 | 12/1967 | Huntzinger | 123/148 E |
| 3,467,876 | 9/1969 | Tatsuzawa | 307/235 E |
| 3,478,512 | 11/1969 | Brahm et al. | 123/32 EA |
| 3,563,219 | 2/1971 | Mieras | 123/148 E |
| 3,587,551 | 6/1971 | Harrow | 123/148 E |
| 3,742,918 | 7/1973 | Murtin et al. | 123/32 EA |
| 3,768,024 | 10/1973 | Letosky | 307/235 E |
| 3,798,467 | 3/1974 | Gottwald | 307/235 E |
| 3,831,570 | 8/1974 | Compton | 125/148 E |

*Primary Examiner*—Ronald B. Cox
*Attorney, Agent, or Firm*—Holman & Stern

[57] ABSTRACT

A spark ignition system includes a variable reluctance pick-up producing output pulses when sparks are required. A capacitor is connected across the pick-up in series with a resistor and stores the integral of the pick-up output. Two voltage comparators compare the voltages on the capacitor and the resistor with threshold levels and a spark is only produced when both voltages exceed the threshold levels, so as to minimise the risk of spurious signals in the pick-up producing a spark.

2 Claims, 3 Drawing Figures

SPARK IGNITION SYSTEMS FOR INTERNAL COMBUSTION ENGINES

This invention relates to spark ignition systems for internal combustion engines.

A system according to the invention includes a variable reluctance pick-up producing output pulses when sparks are to be produced, a spark circuit operable by the pulses for producing sparks, and control means minimising the risk of spurious signals in the pick-up producing a spark.

Preferably, integrating means is provided integrating the pick-up output and permitting a spark to be produced only if the integral exceeds a predetermined value.

In the preferred arrangement, a spark is produced after the integral has exceeded the predetermined value, at the instant when the pick-up output is zero.

In the accompanying drawings.

Figure 1:
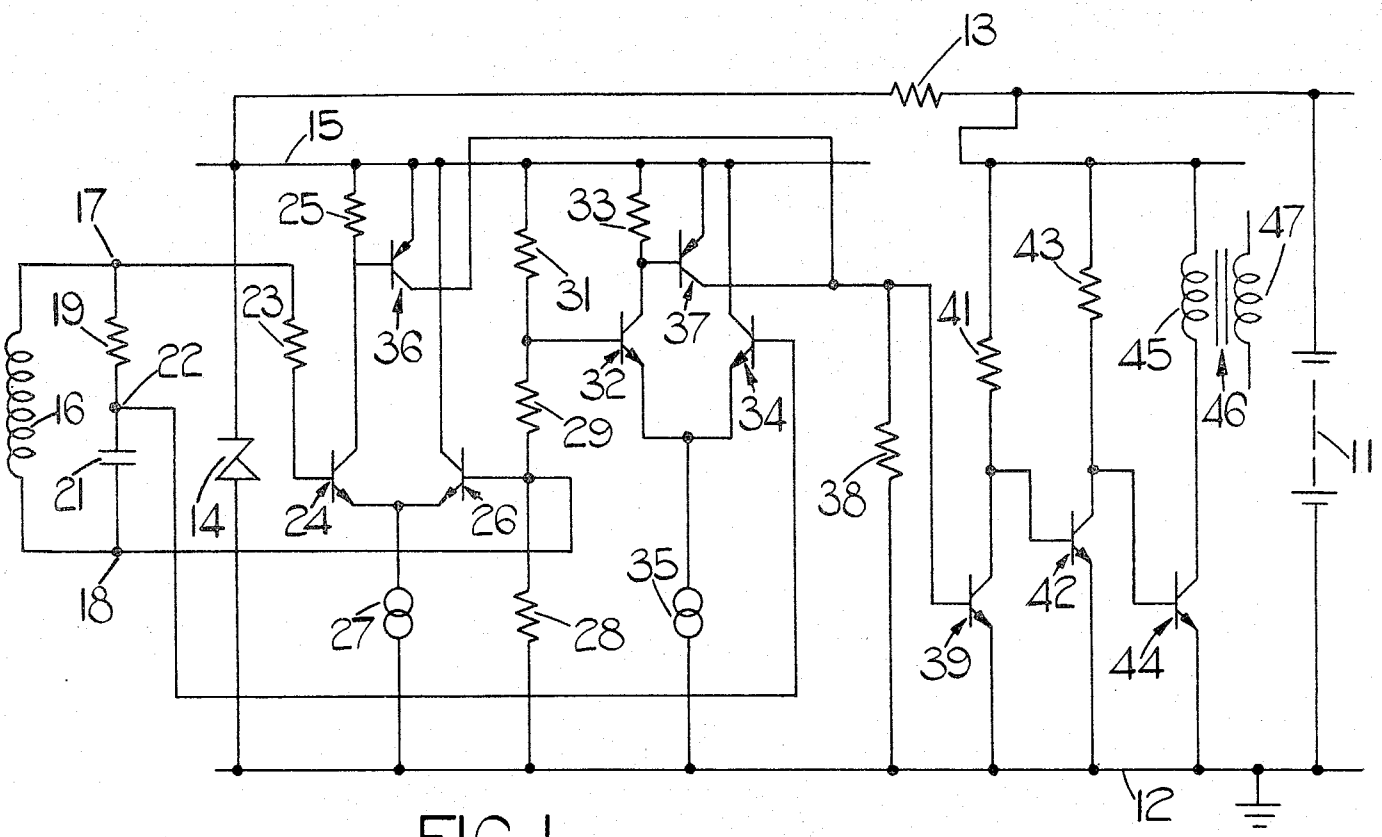
FIG. 1 is a circuit diagram illustrating one example of the invention.

Referring first to FIG. 1, the battery 11 of a road vehicle has its negative terminal connected to an earth supply line 12 and is bridged by a resistor 13 and a Zener diode 14 in series, the junction of the resistor 13 and Zener diode 14 providing power to a positive supply line 15. There is further provided a variable reluctance magnetic pick-up 16 having output terminals 17, 18 bridged by a resistor 19 and a capacitor 21 in series, the junction of the resistor 19 and capacitor 21 providing a third output terminal 22.

The terminal 17 is connected through a resistor 23 to the base of an n-p-n transistor 24 the collector of which is connected to the line 15 through a resistor 25. The terminal 18 is connected to the base of a further n-p-n transistor 26, and the emitters of the transistors 24 and 26 are connected to the line 12 through a constant current source 27. The transistor 26 has its collector connected to the line 15, and its base connected to the line 12 through a resistor 28, and to the line 15 through resistors 29, 31 in series.

The junction of the resistors 31 and 29 is connected to the base of an n-p-n transistor 32 having its collector connected through a resistor 33 to the line 15. The terminal 22 is connected to the base of a further n-p-n transistor 34, the collector of which is connected to the line 15, and the emitters of the transistors 32 and 34 are connected to the line 12 through a constant current source 35.

The collectors of the transistors 24 and 32 are connected respectively to the bases of a pair of p-n-p transistors 36 and 37 having their emitters connected to the line 15, and their collectors connected through a resistor 38 to the line 12, the collectors being further connected to the base of an n-p-n transistor 39, the emitter of which is connected to the line 12 and the collector of which is connected through a resistor 41 to the positive terminal of the battery. The collector of the transistor 39 is connected to the base of an n-p-n transistor 42 having its collector connected through a resistor 43 to the positive battery terminal and its emitter connected to the line 12. The collector of the transistor 42 is further connected to the base of an n-p-n transistor 44, the emitter of which is connected to the line 12 and the collector of which is connected to the positive battery terminal through the primary winding 45 of an ignition transformer 46 having its secondary winding 47 connected to the plugs of the engine in turn through a distributor in the usual way.

When the pick-up 16 is not producing an output, the transistor 26 is on and the transistor 24 is off, so that the transistor 36 is off. However, the transistor 32 is on and the transistor 34 is off, and so the transistor 37 is on. Whenever either of the transistors 36 or 37 is on, the transistor 39 is held on, so that the transistor 42 is off and the transistor 44 is on so that current flows in the winding 45.

The pick-up 16 produces an output of the form shown in the left-hand part of FIG. 2*a* whenever a spark is required. As soon as a positive going pulse appears between the terminals 17, 18, the transistor 24 is turned on so that the transistor 36 conducts. The output from the pick-up 16 is integrated by the capacitor 21, and after a period of time there appears at the terminal 22 a signal which exceeds a threshold value T shown in FIG. 2*b*, this threshold value being the value at which the transistor 34 turns on and the transistor 32 turns off. Thus, when the integral of the output reaches the threshold value, the transistor 37 turns off, but the transistor 39 is still on at this stage because the transistor 36 is on. However, when the output from the pick-up 16 becomes zero, the transistor 24 turns off when the transistor 26 turns on, and at this stage both transistors 36 and 37 are off, so that the transistor 39 turns off, the transistor 42 turns on and the transistor 44 turns off to produce a spark in the usual way. FIG. 2*c* shows the waveform at the collector of the transistor 32, and FIG. 2*d* shows the waveform at the collector of the transistor 24. FIG. 2*e* shows the waveform at the base of the transistor 39, and it will be noted that when the integrated signal falls below the threshold level again, then the transistor 39 is turned on again.

Figure 2:
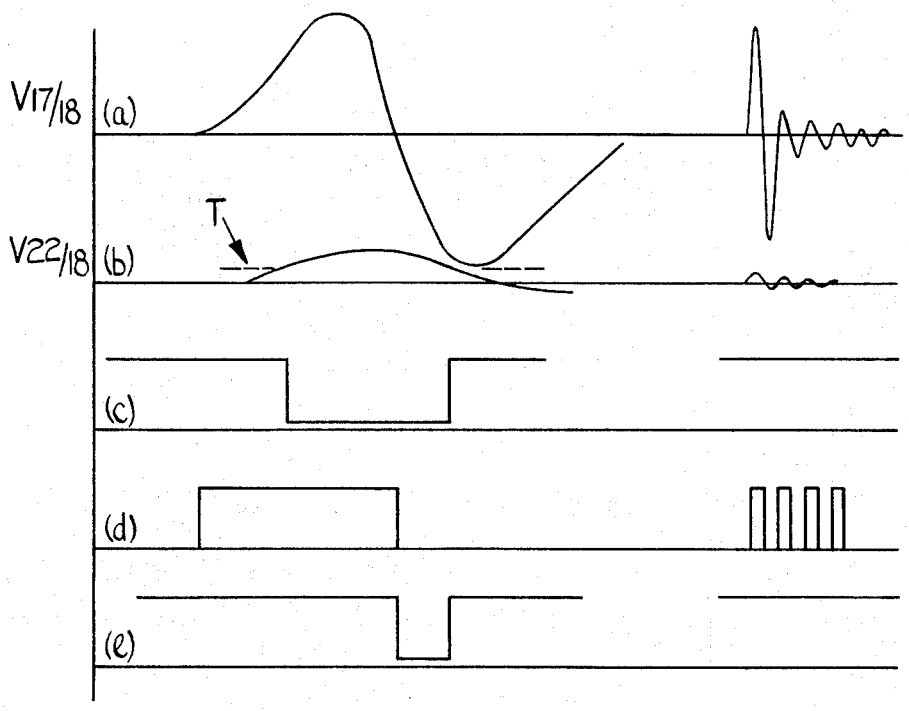
FIG. 2 illustrates a number of waveforms associated with FIG. 1.
Figure 3:
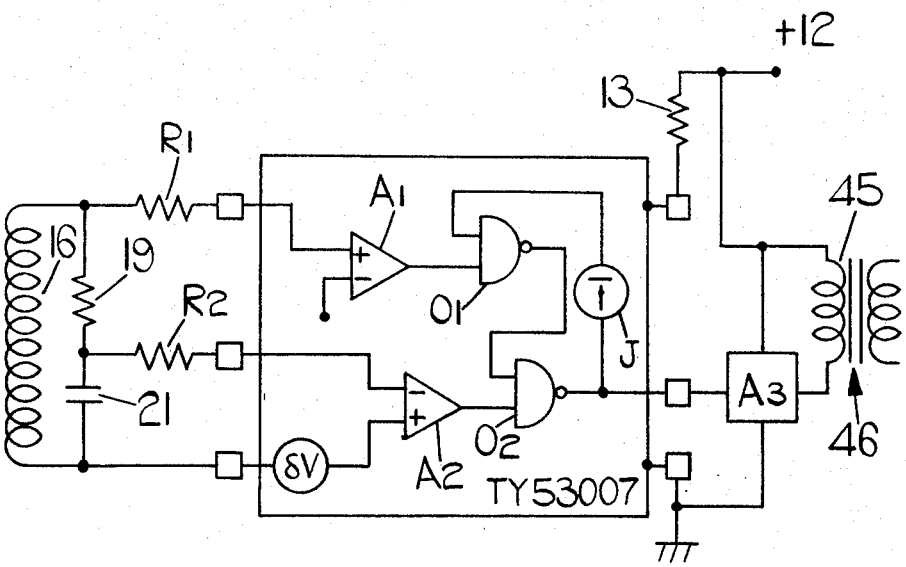
FIG. 3 is a diagram of another example of the invention.

At the right-hand side of FIG. 2 there is shown the effect of noise signals, which generally speaking are of high frequency. Only a small integrated signal appears, and this integrated signal does not reach the threshold level. Although the noise signal has an effect on the transistor 24, as shown in FIG. 2*d*, the transistor 34 remains conductive, and so the transisor 39 remains conductive and no spark is produced.

The alternative example shown in the drawing functions similarly to that described above but makes use of a Motorola integrated circuit No. TY53007. This integrated circuit includes two voltage comparators $A_1$ and $A_2$, two OR gates $O_1$ and $O_2$ and an inverter J. The comparator $A_1$ has its non-invert terminal connected via a resistor $R_1$ to the interconnection of the pick-up 16 and the resistor 19 and its invert terminal connected to earth. The comparator $A_2$ has its invert terminal connected by a resistor $R_2$ to the interconnection of the resistor 19 and the capacitor 21, and its non-invert terminal connected via an internal offset voltage circuit $\delta V$ to the end of the pick-up connected to the capacitor 21 which is earthed.

The output terminals of the two comparators $A_1$, $A_2$ are connected to input terminals of the two OR gates $O_1$ and $O_2$. The output terminal of the gate $O_1$ is connected to another input terminal of the gate $O_2$ and the output terminal of this latter gate is connected via the inverter J to another input terminal of the gate $O_1$. The output of the gate $O_2$ is also connected to an external power amplifier $A_3$ which corresponds to the components 38 to 44 of the discrete component circuit shown in FIG. 1. The output of the amplifier $A_3$ is connected to the primary winding 45 of the transformer 46.

The integrated circuit used includes an internal power supply voltage stabilising zener diode (corresponding to the diode 14) of FIG. 1, but an external dropper resistor 13 is used to connect the circuit to the positive power supply terminal.

The use of the OR gates $O_1$ and $O_2$ and the inverter J ensure that each pulse from the pick-up gives rise to but a single output pulse. Thus any transient in the input to the comparator $A_1$ after a pulse has been produced at the output of the circuit cannot cause a second output to be produced until the logic has been reset by comparator $A_2$.

I claim:

1. A spark ignition system for an internal combustion engine, said system comprising:

a variable reluctance pickup means providing output pulses when sparks are to be produced;

a controllable spark circuit for producing sparks;

an integrating means for integrating the pickup output comprising a resistor and a capacitor serially connected across said pickup means, to respectively provide proportional and integral signals; and control means for the spark circuit providing an output thereto at the instant when the pick-up output is zero, only if the output from the integrating means has exceeded a predetermined value;

said control means comprising a first voltage comparator connected across said capacitor for comparing the integral of the output of the pick-up with a fixed voltage level, a second voltage comparator connected across said resistor for detecting when the output of the pick-up is zero, and a gate circuit for producing an output pulse when the integral of the pick-up output exceeds the fixed voltage level and the output of the pick-up is zero; whereby the risk of spurious pick-up signals producing a spark is minimized.

2. A spark ignition system for an internal combustion engine, said system comprising:

a variable reluctance pickup means providing output pulses when sparks are to be produced;

a controllable spark circuit for producing sparks;

an integrating means for integrating the pickup output; and control means for the spark circuit providing an output thereto at the instant when the pick-up output is zero, only if the output from the integrating means has exceeded a predetermined value, whereby the risk of spurious signals in the pick-up producing a spark is minimized;

said control means comprising a first voltage comparator for comparing the integral of the output of the pick-up with a fixed voltage level, a second voltage comparator for detecting when the output of the pick-up is zero, and a gate circuit for producing an output pulse when the integral of the pick-up output exceeds the fixed voltage level and the output of the pick-up is zero;

said gate circuit comprising first and second two-input OR gates each having one terminal connected to the output of the associated one of the first and second comparators, the output terminal of the second OR gate being connected to the other input terminal of the first OR gate and the output terminal of the first OR gate providing the output of the control means and also being connected via an inverting circuit to the other input of the second OR gate.

* * * * *